United States Patent [19]

DuBois

[11] Patent Number: 4,719,826

[45] Date of Patent: Jan. 19, 1988

[54] LIGHT BULB EXTRACTOR

[76] Inventor: Roger D. DuBois, 12516 Genesee Ave., Apple Valley, Minn. 55124

[21] Appl. No.: 869,582

[22] Filed: Jun. 2, 1986

[51] Int. Cl.[4] ..... B25B 13/50

[52] U.S. Cl. ..... 81/53.12; 294/19.1; 294/99.1

[58] Field of Search ..... 81/53.1, 53.11, 53.12; 294/19.1, 99.1, 22, 33

[56] References Cited

U.S. PATENT DOCUMENTS

| | | | |
|---|---|---|---|
| 556,959 | 3/1896 | Butterfield | 81/53.11 |
| 840,102 | 1/1907 | Bates . | |
| 869,836 | 10/1907 | Gaynor | 81/53.12 |
| 1,157,617 | 10/1915 | Conrad . | |
| 1,201,506 | 10/1916 | Rozelle | 81/53.12 |
| 1,366,296 | 1/1921 | Swider | 81/53.12 |
| 2,766,060 | 10/1956 | Fuller | 294/20 |
| 2,803,484 | 8/1957 | Puckett | 294/33 |
| 3,093,402 | 6/1963 | Sisson | 294/19.1 |

*Primary Examiner*—Debra Meislin
*Attorney, Agent, or Firm*—Donald A. Jacobson

[57] ABSTRACT

A steel U-shaped pair of gripping arms are formed from steel having the proper size and shape to fit over the end of a lamp bulb. The tips of the gripper arms are formed to fit the end of the bulb and the steel is then annealed to obtain the required spring characteristics. The tips of the gripping arms are covered with plastic to provide friction between the gripping arms and the bulb. A chain is attached between the arms with a second chain attached to its center. Pulling the second chain will close the gripping arms. A slot is provided to secure the second chain to hold the arms at any desired span. Extensions can be attached to the gripper arms when the device is used on high overhead lamps. The steel used in the gripper arms is thin to fit between the bulb and fixture when the bulb is mounted in deep fixtures.

1 Claim, 5 Drawing Figures

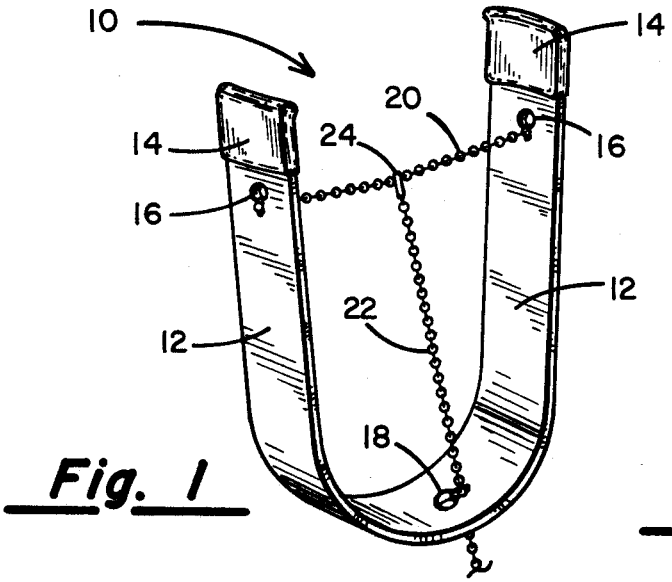
Fig. 1
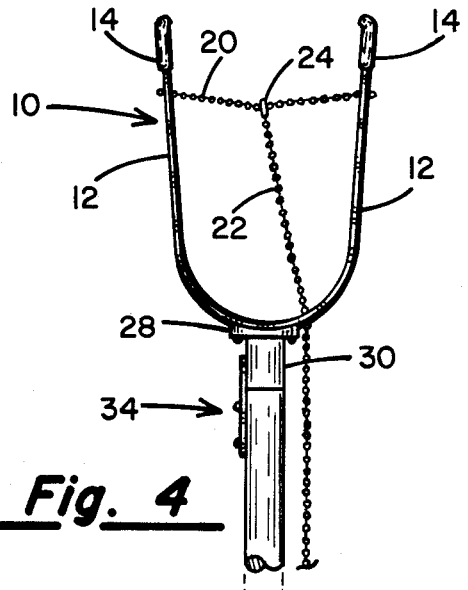
Fig. 4
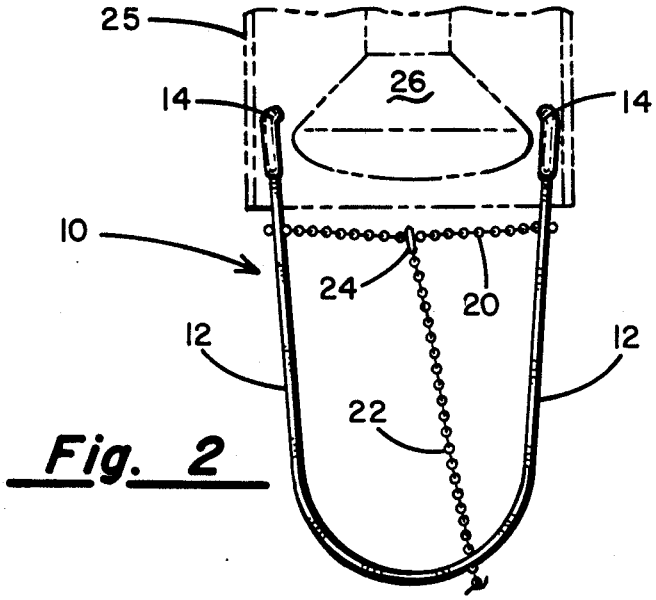
Fig. 2
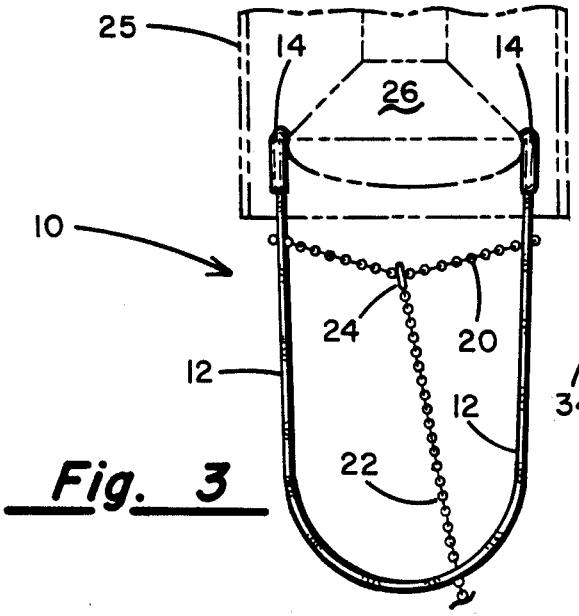
Fig. 3
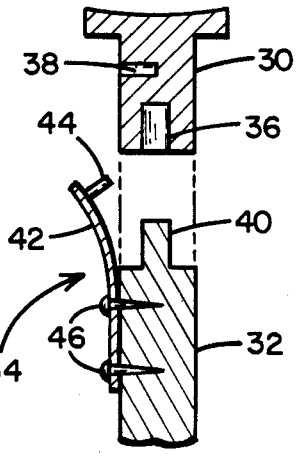
Fig. 5
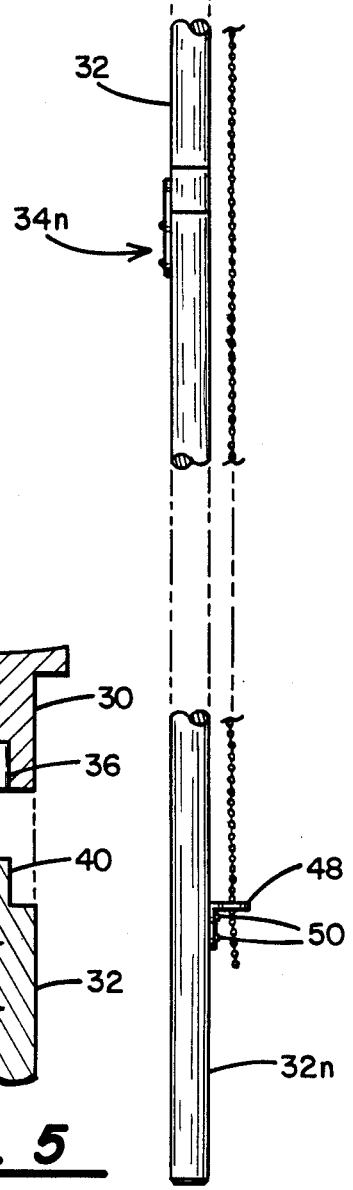

LIGHT BULB EXTRACTOR

BACKGROUND OF THE INVENTION

I. Field of the Invention

This invention relates generally to a gripper for installing and removing lamp bulbs from their sockets and particularly for installing and removing parabolic reflector lamp bulbs from a long cylindrical shaped lamp fixture.

II. Description of the Prior Art

There are a number of devices adapted to install and remove lamp bulbs or similar objects. In Puckett, U.S. Pat. No. 2,803,484; Fuller, U.S. Pat. No. 2,766,060; Conrad, U.S. Pat. No. 1,157,617; and Bates, U.S. Pat. No. 840,102 a number of gripping and handling devices are taught. In Puckett an electronic tube handler using a trigger assembly acting through cords pulls a pair of arms together. Adjustment means is also provided. In Fuller four equally spaced spring jaws are snapped over a light bulb to provide the clamping means to remove a lamp bulb. An extension permits using this means at a distance for overhead lamps. In Conrad a gripping means held on an extension fits about the circumference of a lamp bulb. The gripping means has a gap which is closed to secure the lamp. In Bates a pair of rotating jaws are held outward by springs and are forced together about a lamp bulb by the bulb bearing against the lower portion of the jaws.

None of these devices utilize the absolute minimum number of parts as the instant device while providing any desired gripping action with a locking provision.

SUMMARY OF THE PRESENT INVENTION

This present invention is directed to a device for removing electric lamp bulbs from fixtures. This device is directed particularly to removing lamp bulbs with a built in parabolic reflector, commercially called PAR lamp bulbs, from deep cylindrical shaped lamp fixtures. These lamp bulbs are enclosed and deeply recessed by these fixtures. This type of fixture also has a very small space between the lamp bulb and the cylindrical interior of the fixture.

To remove a PAR lamp bulb from such a deep cylindrical fixture, a gripping means which can physically fit between the bulb and fixture having considerable strength must be employed. These requirements are met here by a gripper formed from a thin steel strip into a U-shape with the U having the proper span and length to fit around the lamp bulb and with the tips of the gripper arms curved and shaped to fit the exposed end of the bulb. The steel is first stamped into the proper shape and after stamping is annealed to obtain the desired spring characteristics.

In order to rotate and remove bulbs which are held tightly by the matching sockets, there must be a great deal of friction between the bulb and the gripper. The friction between the two is increased by coating the tips of the gripper with a plastic having a relatively high coefficient of friction. Since the tips are the only portion of the gripper that physically touch the lamp bulb, this greatly increases the amount of torque that can be exerted on the lamp bulb by the gripper in removing the bulb.

In order to prevent breaking the bulb the gripper should be clamped on the lamp bulb with a predetermined force. To accomplish this there is the need for an adjusting means on the gripper. This is accomplished here by simply using two ball chains, one of which is secured between the two interior sides of the gripper arms with enough length such that the arms are not pulled inwardly.

The second ball chain has one end secured to the center of the first chain and led downward extending through a hole in the gripper arm which is offset to one side from the center of the gripper. This hole is large enough that the balls in the chain will readily pass through the hole. This hole has a slot from the side of the hole directed toward the tips which will admit the link between the balls on the chain but will not admit the balls.

These two chains and slotted hole provide the adjusting means for the gripper arms. Holding the gripper in one hand and pulling on the second chain will pull the first chain into a V shape and pull one gripper arm towards the other. The gripper arms can be secured at any location by sliding the second chain over into the slot from the hole and releasing tension on the chain. The spring action on the gripper arms will pull on the first chain attempting to straighten it. This force will pull inward on the second chain which will pull the outer ball adjacent to the slot against the gripper arm and will hold the chain in place. This will act as a lock to secure the gripper arms at the selected spacing and provides a means of adjusting the gripper arms. The arms can be placed over the lamp bulb, the second chain pulled until the desired tension is obtained and the chain locked in that position to maintain the tension.

This device provides a simple means for removing a lamp bulb from a deep socket. The arms are thin enough to fit between the bulb and socket and can be inserted by holding the gripper in one hand and the tension can be adjusted by pulling on the second chain by the other hand and then locked at the desired tension by sliding the chain into the slot. This permits obtaining the desired tension and will maintain this tension until the chain is unlocked. After locking the gripper is then rotated to remove the lamp bulb and after removal of the bulb the second chain is unlocked to release the gripper arms from the lamp bulb.

A receptacle is provided on the center of the gripper opposite the arms for an extension which can be snapped into place on the gripper and locked to prevent rotation between the extension and gripper. The extension has a similar receptacle on the opposite end to receive an identical extension. This permits as many extensions as desired to be attached to the gripper to reach light bulbs located in high fixtures without the necessity of a ladder. The last extension is provided with a right angle bracket having a slot in one of the angles which is mounted with the slot perpendicular and extending outward from the long axis of the extension. This slot is the same size as the slot in the gripper used to lock the ball chain. An extension to the second ball chain is attached which will reach slightly past the bracket on the last extension. This will permit locking the gripper arms from the last extension. This permits attaching the gripper arms to an overhead fixture using as many extensions as are necessary, locking the gripper arms in the usual manner, and rotating the lamp bulb free by rotating the extension.

This device provides a simple to use lamp bulb remover which will fit within any fixture with the minimum of complexity or parts. There are essentially no moving parts to wear out. The gripper arms are adapted to fit a parabolic lamp bulb because the type of cylinder fixture used with this bulb fits the closest to the bulb making these lamps the most difficult to remove. This device however will work equally well with conventional shaped lamp bulbs because of the curved cross-section of the tips of the arms and the friction coating of these tips.

BRIEF DESCRIPTION OF THE DRAWINGS

FIG. 1 is an isometric view of the device in an open position.

FIG. 2 is a front view of the device in an open position located to grasp a parabolic lamp bulb mounted within a fixture, with the lamp and fixture shown in dashed outline.

FIG. 3 is the same as FIG. 2 excepting that the device is shown in a closed position grasping the bulb.

FIG. 4 is the device with a number of extensions attached.

FIG. 5 is the attachment of the extensions to the lamp bulb gripper from FIG. 4, shown in cross-section.

DESCRIPTION OF THE PREFERRED EMBODIMENT

In FIG. 1 a lamp bulb gripper 10 is shown. Gripper 10 is formed from a strip of steel into a U-shape having two symmetrical arms 12 with each tip covered with plastic ends 14 to provide friction. The tips are each curved symmetrically about the long axis of the respective arm 12 to match the rounded lamp bulb circumference with an inward projection at the extreme end to engage the lamp bulb end. Gripper 10 has two opposing openings 16 in the arms and an offset opening 18 between the two arms. Openings 16 each are in the form of a circle with a slot directed toward the center while opening 18 has the same size and form with the slot directed outward from the center. After gripper 10 is formed into this shape with the described openings the steel is annealed to a spring characteristic.

A ball chain 20 is secured between arms 12 through the openings 16. The circular portions of openings 16 are large enough to permit the balls of chain 20 to pass through while the slots directed to the center are narrower than the balls but wider than the wires holding the balls together. Chain 20 is secured between arms 12 by extending at least one of the balls on each end of the chain through the circular part of its respective opening 16, then moving the ball on the chain adjacent to the outside of respective opening 16 away from the tip where the slot portion of the opening will not allow the ball to be pulled through. This provides a simple means of attaching chain 20 and also permits adjusting the distance between the arms 12 if desired by merely placing more of the balls on the chain on the outside of the arm.

A second ball chain 22 is attached to the center of chain 20 by a fastener 24 and extends through the circular portion of opening 18. Chain 22 is the same size as chain 20 and can be locked in position in opening 18 by being moved outward into the slot which will not permit the balls of the chain to pass through and thus secure the chain in place.

Referring to FIG. 2 the lamp bulb gripper 10 is shown within a cylindrical shaped lamp fixture 25 about the exposed end of a parabolic reflector lamp bulb, also called PAR bulb 26. The thin metal used to form gripper 10 permits arms 12 to be positioned around PAR bulb 26 within fixture 25. Note that the curved tips fit the curve of PAR lamp 26 to increase the friction between the two. Here chain 20 is essentially straight and does not deflect arms 12 inward.

Referring to FIG. 3 chain 22 has been pulled downward through opening 18, not shown in this figure, which in turn pulls the center of chain 20 downward and pulls arms 12 inward toward each other to clamp plastic ends 14 of the arms about PAR lamp 26. The more tension that is exerted downward on chain 22 the tighter plastic ends 14 will grip PAR lamp 26. When the desired tension is attained chain 22 is moved outward into the slotted portion of opening 18 to lock the chain in this position. Gripper 12 can then be rotated to remove PAR lamp bulb 26. After PAR lamp bulb 26 has been removed from center fixture 25 chain 22 is slid to the center from the slot in opening 18 to remove the bulb from gripper 10.

In FIG. 4 lamp bulb gripper 10 has a connector 28 centered between arms 12 and attached to the bottom by means of two rivets through aligned properly sized holes in the connector and the gripper. A cylindrical shaped wooden stub 30 is attached to connector 28.

A cylindrical shaped wooden extension 32 is connected to stub 30 and is secured in place by a latch 34. FIG. 5 shows the details of the operation of latchs 34 and 34*n*. Stub 30 and the lower end of extension 32 both have a cylindrical shaped hole 36 coaxial with the outer surface and a radial hole 38 from the outer surface. Extensions 32 and 32*n* both have a cylindrical shaped reduced extension 40 on the upper end which is of the proper length and radius to fit within opening 36. Latch 34 and latch 34*n* consist of a spring steel strip 42 with an inner projection pin 44 which is secured to extension 32 or 32*n* by means of two nails 46 through suitable sized holes in strip 42.

Steel strip 42 normally holds projection 44 inward. To attach extension 32 to stub 30 or 32*n* to 32 strip 42 is pulled outward until pin 44 is held outside the greater diameter of extension 32. Reduced extension 40 of extension 32 is inserted into hole 36 until pin 44 is aligned with radial hole 38. Pin 44 is dimensioned and located on strip 42 such that when extension 40 is fully within hole 36 the pin can be inserted within radial hole 38 to hold extension 32 in place against stub 30 and extension 32*n* in place against extension 32. As many extensions as desired can be connected together in this manner to reach high ceiling fixtures. Pins 44 prevent the extensions from rotating one with respect to the other when the lowest one is rotated to remove or insert a lamp.

A right angle bracket 48 is secured to extension 34*n* by two nails 50 through suitable size holes in the bracket. The portion of bracket 48 which is perpendicular to the long axis of extension 34*n* has a slot, not shown, which is the same size as the slot portion of holes 16 and 18, and which is perpendicular to the long axis of the extension. An extension is attached to chain 22 which is the same size as the chain and will reach slightly beyond bracket 48 with the chain threaded through hole 18. This permits closing arms 12 from the end of extension 32*n* and locking the arms in place using bracket 48 in the same manner as the slot in hole 18. Note that the slot in hole 18 is directed away from the center of gripper 10 and since chain 22 will be pulled toward the center by any tension the slot in hole 18 will not engage the chain. After the lamp is extracted by rotating extension 32*n* chain 22 is removed from the slot in bracket 48 to release arms 12 from the lamp.

These extensions provide an inexpensive simple means for elevating gripper 10 to any necessary height to insert or remove a lamp.

I claim:

1. A light bulb extractor comprising:

(a) a generally U-shaped gripper having two opposing arms with each opposed arm of said gripper formed into a predetermined shape to fit the end of a light bulb;

(b) said U-shaped gripper formed of steel and after forming annealed to spring characteristics;

(c) wherein said arms of said gripper are each coated on their extremities with a material having a high coefficient of friction;

(d) locking means for securing said gripper arms at any desired span as a means of adjusting the gripping force of said arms, said locking means consisting of a flexible link attached between said gripping arms and a ball chain attached to the center of said flexible link, with said chain threaded through a hole near the center of said gripper of an adequate size to admit the balls of said chain, with said hole having an integral slot on one side, said slot being of a smaller width than the balls of said chain and a larger width than the connecting links between said balls to permit securing said chain within said slot at a number of positions; and (e) a means for attaching a first extension to said gripper, and said first extension having means for attaching a second extension thereto.

* * * * *